United States Patent [19]

Draugelis et al.

[11] 4,082,443

[45] Apr. 4, 1978

[54] SYSTEM FOR SUPERPOSITION OF COLOR SEPARATION IMAGES

[75] Inventors: Vaidevutis C. Draugelis, Rochester; Eugene D. Schafer, Fairport, both of N.Y.

[73] Assignee: Xerox Corporation, Stamford, Conn.

[21] Appl. No.: 647,470

[22] Filed: Jan. 8, 1976

[51] Int. Cl.[2] ..... G03G 15/01

[52] U.S. Cl. ..... 355/4; 355/14; 355/50; 355/69

[58] Field of Search ..... 355/14, 4, 16, 50, 69, 355/3 R

[56] References Cited

U.S. PATENT DOCUMENTS

| | | | |
|---|---|---|---|
| 3,734,607 | 5/1973 | Davis et al. | 355/4 |
| 3,744,900 | 7/1973 | Reesen | 355/14 |
| 3,844,552 | 10/1974 | Bleau et al. | 355/75 |
| 3,917,396 | 11/1975 | Donohue et al. | 355/14 |
| 3,917,400 | 11/1975 | Rodek et al. | 355/14 |

*Primary Examiner*—Fred L. Braun

[57] ABSTRACT

A multicolor electrostatic printing machine having processing components to produce a copy of a color original comprising color separation masters which represent each color of the original and move along an exposure station as they are exposed by a flash assembly. Latent images of the masters on a photoconductor are developed at a development station, and the developed images transferred in superposition to support paper at a transfer station. Digital logic circuitry ensures that the latent images are correctly placed on the photoconductor, such that the images are superimposed, by varying the timing of the flash assembly in dependence on the relative positions of the moving masters and the support paper.

6 Claims, 6 Drawing Figures

SYSTEM FOR SUPERPOSITION OF COLOR SEPARATION IMAGES

BACKGROUND OF THE INVENTION

This invention relates to a color reproduction system to effect automatically high speed color processing and the production of color copies and, more specifically, to a system for the automatic exposure of moving documents to be copied, and the superposition of sequential images of the documents on a final support medium.

In recent years there has been a number of attempts to use electrostatic printing for the production of faithful color renditions of multi-colored originals. One such system, described in U.S. Pat. No. 3,724,943 to Draugelis et al., uses an endless panchromatic photoconductor belt which is moved in an endless path having at least two flat runs. One of the flat runs is utilized at an exposure station at which a stationary color original is exposed by means of flash, full-frame exposure. The original being reproduced is subject to a series of successive, multiple exposures, and a light filter device, having a separation color filter for each color desired to be reproduced, is utilized and arranged to present one filter during each of the exposures so that the original is exposed once for each color rendition. Another flat run is utilized at a development station for developing the resultant electrostatic latent image. At this station there is positioned a plurality of in-line developing devices each of which is adapted to develop an image with a corresponding subtractive color material.

A programming arrangement is utilized along with the plurality of color filters for exposing the stationary original a plurality of times, once for each color, wherein successive images, each of a different color, are produced and wherein the plurality of latent images are presented in succession to the developing station. The programmer also controls the activation of each of the developing devices for respectively developing the latent images by a developing device. The programmer also includes means for controlling the disposition of a sheet of paper at a transfer station so that the sheet is brought into transfer relationship with the developed images in a recirculating basis; that is, one application of the sheet of paper into the photoconductive belt for each different color image to be transferred.

A problem posed by a system in which one developed separation color image is to be superimposed upon another, is ensuring that the developed images are placed in perfect registration upon each other at the transfer station. In the above-mentioned U.S. Pat. No. 3,724,943, use is made of a bias transfer roll, supporting a sheet material, which is successively moved into and out of contact with the photoconductor belt bearing the developed separation color images, and which is rotated an entire cycle between superposition of one separation image on another on the sheet material.

The system disclosed in U.S. Pat. No. 3,724,943 provides proper registration or superposition of the developed separation color images at the transfer station because a stationary original is used; that is an original which is fixed on a platen during exposure. This means that with a plurality of synchronized flash exposures of the original, the separation distance between the latent color images on the photoconductor is kept constant and placement of the latent images on a particular area of the belt is exactly provided. Thus, the latent images are placed on the photoconductor at a position with respect to the bias transfer roll such that the developed images will always be superimposed on the roll. As more fully described in the above-mentioned U.S. patent, an electro-mechanical programming or synchronization system is used, whereby the timing of the flash exposure is synchronized with movement of the bias transfer roll and with movement of the photoconductor belt.

In recent years, interest has been shown in an electrostatic color reproduction system in which it is required to copy a color document having its color information stored on a plurality of color separation masters. Each of these color separation masters include a black and white image having information as to the particular color content of the color document. For example, one master may be a black and white transparent film having only blue color information of the color document, a second film may be a black and white transparency having only red color information of the document, and a third film may be a black and white transparency having only green color information. The process of making such color separation masters is well-known.

To make a color reproduction, the color separation masters are spaced apart on a movable support and moved past the exposure station. As each separation master enters the exposure station, the image is exposed by means of a flash, full frame exposure and a latent image is placed on the moving photoconductor belt.

As may be seen from the above with respect to a system using a stationary original, it is important that the latent images be placed precisely on the photoconductor with respect to a particular circumferential position of the transfer roll occur to assure accurate registration of the separate color images on a transfer sheet material. However, with moving images to be copied, the correct placement of the latent images on the moving photoconductor, such that the separation distances are constant and the latent images are properly located on the photoconductor, is difficult to attain. For example, if the electro-mechanical system of U.S. Pat. No. 3,724,943 were used with moving color separation masters, flash exposure would always occur at a predetermined time in relation to movement of the bias transfer roll and photoconductor belt; however, whereas the first and second color separation masters may be properly located at the exposure station at the time of flash, the third color separation master might not be, whereby the separation distance between the latent images on the belt of the second and third color separation masters is different from the separation distance between the first and second latent images corresponding to the first and second color separation masters. Consequently, at the transfer station, the developed second latent image would be superimposed on the first developed image, but the third developed image would not be.

There are several reasons why the color separation images might not be properly positioned in the exposure station at the time of flash. Each of the color separation masters may be placed in a frame on a movable conveyor, and as the latter moves the masters may slide slightly within the frame. The masters cannot be very tightly fixed in the frames; otherwise, it would be difficult and time consuming for an operator to load the masters to make copies. Also, during movement of the conveyor for the masters, there may be some minute speed changes, resulting in delaying or advancing the placement of the masters in the proper location of the exposure station with respect to the time of flash. Furthermore, there might be slight changes in the speed of the transfer roll as transfer of the separation images occurs, which speed changes in the above-mentioned patent would result in variation of the timing of the flash. Misregistration of the color separation masters may be slight; however, this is sufficiently substantial to result in undesireable degradation of the color copy.

SUMMARY OF THE INVENTION

It is an object of this invention to provide a novel multicolor copying system.

It is another object of this invention to provide a novel means for accurate superposition of separation images on a transfer sheet at a transfer station.

It is a further object of this invention to superimpose, at a transfer station, separation images formed on a moving photoconductor from moving documents.

It is a still further object of the present invention to provide a multicolor copying system in which the timing of flash exposure is varied in dependence on the position of each of several color separation masters.

It is yet another object of the present invention to provide electronic digital circuitry for determining the timing of the flash exposure.

It is a still further object to position an image on paper.

The foregoing and other objects of the present invention are obtained by means of a system in which the timing of the flash exposure is automatically determined in relation to the position of each of the color separation masters at the exposure station with respect to the position of a timing mark on a bias transfer roll at a transfer station. At the transfer station, as the bias transfer roll rotates, the timing mark on the transfer roll is sensed and a counter reset to start counting the output of a clock. Then, a timing mark located on a separation master is sensed as the master moves near to the exposure station. The count of the counter now corresponds to the time between sensing the timing mark on the bias transfer roll and the timing mark on the film, and this count also relates to the position of the master relative to the position on the bias transfer roll at which transfer should occur. A computer then receives a signal corresponding to this time difference and, based on this information, calculates the time at which flash exposure should occur with respect to the particular color separation master. The computer then generates a signal corresponding to the time flash exposure should occur from the time the master timing mark is sensed and feeds it to a comparator as one input. The comparator receives as another input from the clock a signal indicating that the time for flash exposure has elapsed, i.e., a signal identical to the computer generated signal, the comparator provides an output signal which is then used to turn on the flash exposure assembly. Thus, the master is exposed at a time such that a latent image is properly located on the photoconductor belt with respect to the bias transfer roll and other latent images for accurate superposition at the transfer station.

BRIEF DESCRIPTION OF THE DRAWINGS

For a better understanding of the invention as well as other objects and further features thereof, reference is made to the following detailed disclosure of a preferred embodiment of the invention taken in conjunction with the accompanying drawings thereof.

Figure 1:
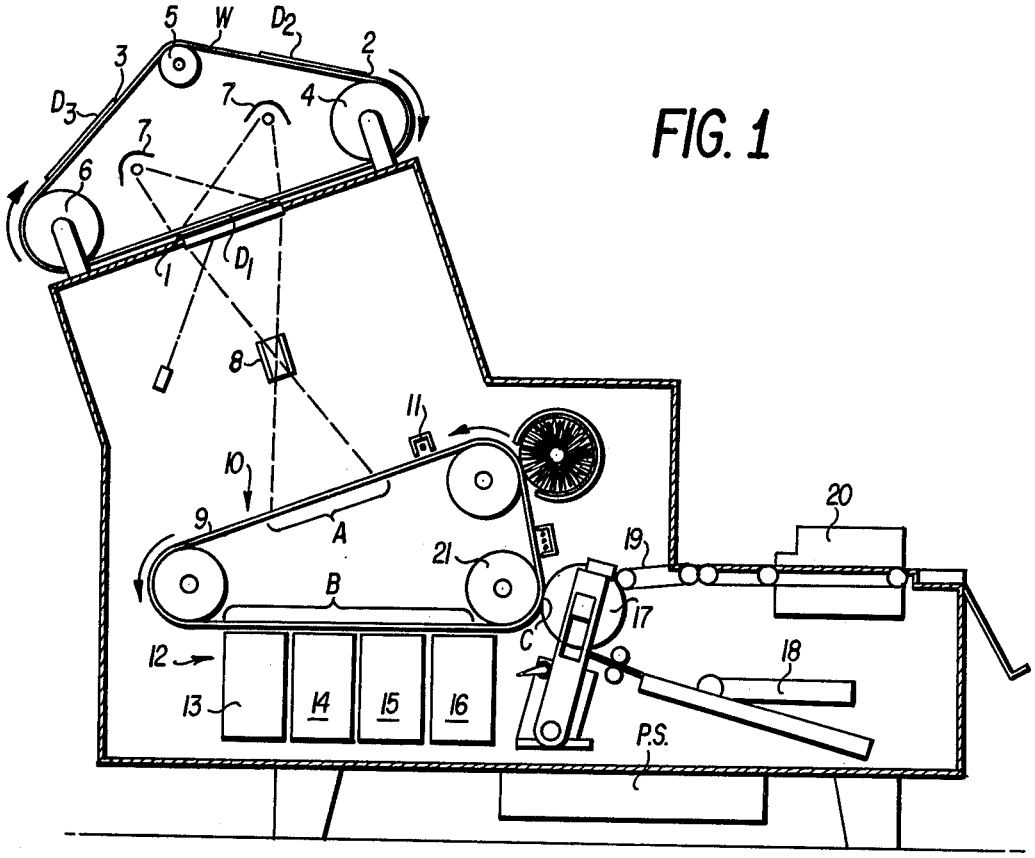
FIG. 1 is a schematic of a reproduction machine showing various electrostatic processing components of the present invention.

As in all electrostatic systems such as a xerographic machine of the type illustrated in FIG. 1, a light image of a document to be reproduced is projected onto the sensitized surface of a xerographic plate to form an electrostatic latent image thereon. Thereafter, the latent image is developed to form a xerographic powder image, corresponding to the latent image on the plate surface. The powder image is then electrostatically transferred to a support surface to which it may be fixed by a fusing device whereby the powder image is caused permanently to adhere to the support surface.

The machine illustrated in FIG. 1 is intended to make color copies of an original document comprising three color separation transparent masters $D_1$, $D_2$ and $D_3$ each including a black and white image of a particular color of a color document, as is known. For example, transparent master $D_1$ may include a black and white image of the red content of the color document, transparent master $D_2$ may include a black and white image of the green content of the color document and transparent master $D_3$ may include a black and white image of the blue content of the color document. The method of making such transparent masters is well known and need not be described for a proper understanding of the present invention.

The transparent masters $D_1$, $D_2$ and $D_3$ are placed on a movable support web W having three apertures 1, 2 and 3 in which the masters may be easily supported. The web W is carried about three rollers 4, 5 and 6 in a clockwise direction as shown by the arrows about web W in FIG. 1.

The web W moves relative to an illumiation assembly 7 positioned at the upper end of the machine as viewed in FIG. 1. As the transparent masters $D_1$, $D_2$ and $D_3$ move into the imaging area, a lamp control circuit for the machine causes energization of the lamps in the lamp assembly 7 to provide light rays which pass through the masters. The image rays are projected by means of an optical lens system 8 for exposing the photosensitive surface of a xerographic plate at the exposure station A, the plate being in the form of a photoconductive belt 9 arranged on a belt assembly generally indicated by the reference numeral 10.

The photoconductive belt assembly 10 may be mounted upon the frame of the machine and is adapted to drive the belt 9 at a constant rate in the counterclockwise direction as shown by the arrow in FIG. 1. During this movement of the belt 9, the light imaging rays of masters $D_1$, $D_2$ and $D_3$ are successively flashed full frame upon the surface of the belt. The belt structure utilized comprises a layer of photoconductive insulating material such as selenium on a conductive backing that is sensitized prior to exposure by means of a suitable corona charging device 11.

The flash exposure of the belt surface to the light image discharges the photoconductive layer in the areas struck by light, whereby there remains on the belt 9 an electrostatic latent image for each exposure, each being in image configuration corresponding to the light image projected from the masters $D_1$, $D_2$ and $D_3$. As the surface of belt 9 continues its movement, the latent electrostatic images pass through a developing station B at which there is positioned a developer assembly generally indicated by the reference numeral 12 and where the belt 9 is maintained in a flat condition. The developer assembly 12 comprises a plurality of developing devices 13, 14, 15 and 16 each of which contains a different color developing material to provide individual development of the electrostatic separation images corresponding to the different color information imaged on the separation masters $D_1$, $D_2$ and $D_3$.

The successively developed electrostatic images are transported by the belt 9 to a transfer station C where a sheet of copy paper is moved at a speed in synchronism with the moving belt 9 in order to accomplish transfer of the developed images. There is provided at this station a sheet transport mechanism in the form of a transfer drum or electrically biased transfer roll 17 adapted to support a sheet S of paper and to carry the same into image transfer relationship with the belt 9 once for each image transfer operation. The sheet of paper S from a paper handling mechanism, generally indicated by the reference numeral 18, is transported into position upon the drum 17 where it is supported during the image transfer function. The transfer of the developed image from the selenium belt surface to sheet material is effected by means of an electrical bias, of the opposite polarity as the triboelectric charge on the developing particles utilized in image development, which is applied to the transfer drum or roll 17 at the point of contact between the sheet and selenium belt as the sheet passes the transfer station C.

After the sheet is stripped from the transfer drum 17, it is conveyed by conveyer 19 into a fuser assembly, generally indicated by the reference numeral 20, which permanently fixes developed and transferred powder image on the sheet material. Afer fusing, the finished copy is discharged from the apparatus at a suitable point for collection externally of the apparatus.

For each reproduction cycle, each master $D_1$, $D_2$ and $D_3$ is exposed once, thereby producing three latent electrostatic images on the surface of the belt 9. Each of the three latent images is representative of a particular color in the original color document either in its pure form or for a color mix in the document. As the first latent image is moved into the developing station B, the color unit, which is adapted to provide development with a subtractive toner relative to the color information on master $D_1$, is activated. For example, the lead latent image produced from the exposure of the master $D_1$ will be developed by means of the developer unit 13 carrying cyan color toner particles in order to provide red development or for a mixture including red corresponding to red coloring or mixtures thereof present in the original color document and represented by the black and white image of $D_1$. During this development by the red unit 13, the developer units 14, 15 and 16 are held in an inactive condition.

After the first electrostatic latent image has been developed and moves out of the influence of the developer 13, the second latent image, separated from the first latent image, is moved into developing position relative to the green developer unit 14. The unit 14 will develop the second latent image which was produced from master $D_2$ and will, for example, effect the development of this image with magenta color toner particles for those areas of the color original that are green or include green in a mixture, as given by the black and white image on $D_2$. During this second development action by the unit 14, the other units 13, 15 and 16 are maintained in an inactive condition.

After the second latent image has been developed and moved out of the influence of the unit 14, the third electrostatic latent image which was produced by the illumination of master $D_3$ is moved into developing position relative to the blue developer unit 15. During movement of the third latent image past the unit 15, it is developed with yellow color toner particles for the blue areas on the color original and those areas of the color original containing a mixture including blue.

Each of the three powder images produced by the three color developer units is transferred in succession to the sheet of support material S mounted on the transfer drum 17. At transfer station C, the belt 9 is carried around a roller 21 which forms one of the three rollers of the belt assembly 10. Transfer occurs at the line on the belt 9 resulting when the transfer drum 17, which serves as a biased electrode, is in contact with the adjacent surface thereof as it is moved about the roller 21.

In the event only black and white copies of the color original are desired, electrostatic latent images of masters $D_1$, $D_2$, and $D_3$ will be developed by the developer unit 16 containing black toner particles.

As will be more fully described, the operations of the bias transfer roll 17 and photoconductor belt 9 are coordinated with one another, as well as with the developer units 13–16, paper feed mechanism 18 and flash assembly 7. It will be appreciated that in order to obtain proper registration of the three separation images developed at station B on final support sheet S, the latent images must be placed on belt 9 at station A such that their separation distances on the belt are equal, that the separation distances are the same from one copying cycle to another, and that the latent images are in a proper relation to the position of the sheet S on the transfer roll 17.

The above problems have been overcome with a color copying system using an original which is stationary on a fixed platen, as has been described in U.S. Pat. No. 3,724,943. However, in the present invention, in which use is made of color separation masters $D_1$, $D_2$ and $D_3$, which move through the exposure station, for the reasons mentioned previously, there is no assurance that, for example, the separation distance between the latent images produced from masters $D_2$ and $D_3$ is equal to the separation distance between the latent images produced from masters $D_1$ and $D_2$.

In either the present invention or the U.S. Pat. No. 3,724,943, the correct placement of the image on the photoconductor belt 9 is a function of the timing of the flash exposure. The timing of the flash is based on the fact that at some instant the correct latent image position on the photoconductor belt 9 and the image projected from lens 8, i.e., the areal image, are superimposed. Therefore, to account for, for example, relative movement of the masters $D_1$, $D_2$ and $D_3$ with respect to one another, and hence, with respect to the correct position on transfer roll 17 for image transfer, the present invention provides apparatus to vary the timing of the flash in relation to such position of the bias transfer roll.

Figure 2A:
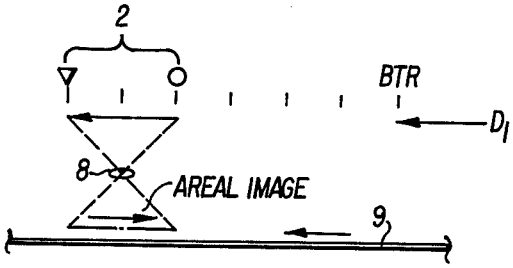
FIGS. 2A, 2B, 2C are drawings useful in explaining the principal of the present invention.
Figure 2B:
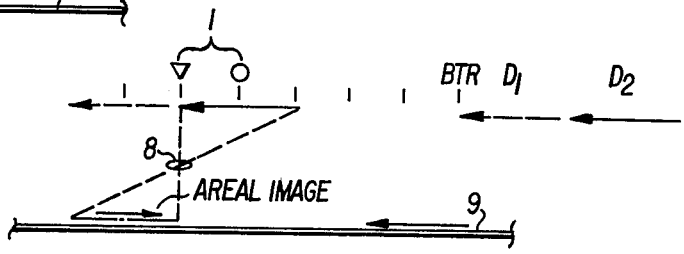
Figure 2C:
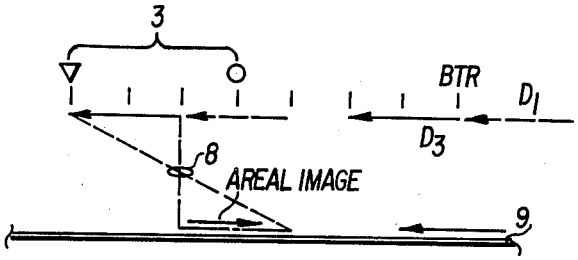

As shown in FIG. 1, the masters $D_1$, $D_2$ and $D_3$ and photoconductor belt 9 are moving in the same direction at exposure station A. Thus, the areal image from lens 8 is moving in the opposite direction to that of belt 9. With reference to FIGS. 2A, 2B and 2C, at some instant the areal image and a portion of a photoconductor belt 9 cross each other such that a latent image may be placed on the latter and will be in a position for proper registration on sheet S at bias transfer roll 17; at such instant a flash exposure should be made.

Figure 4:
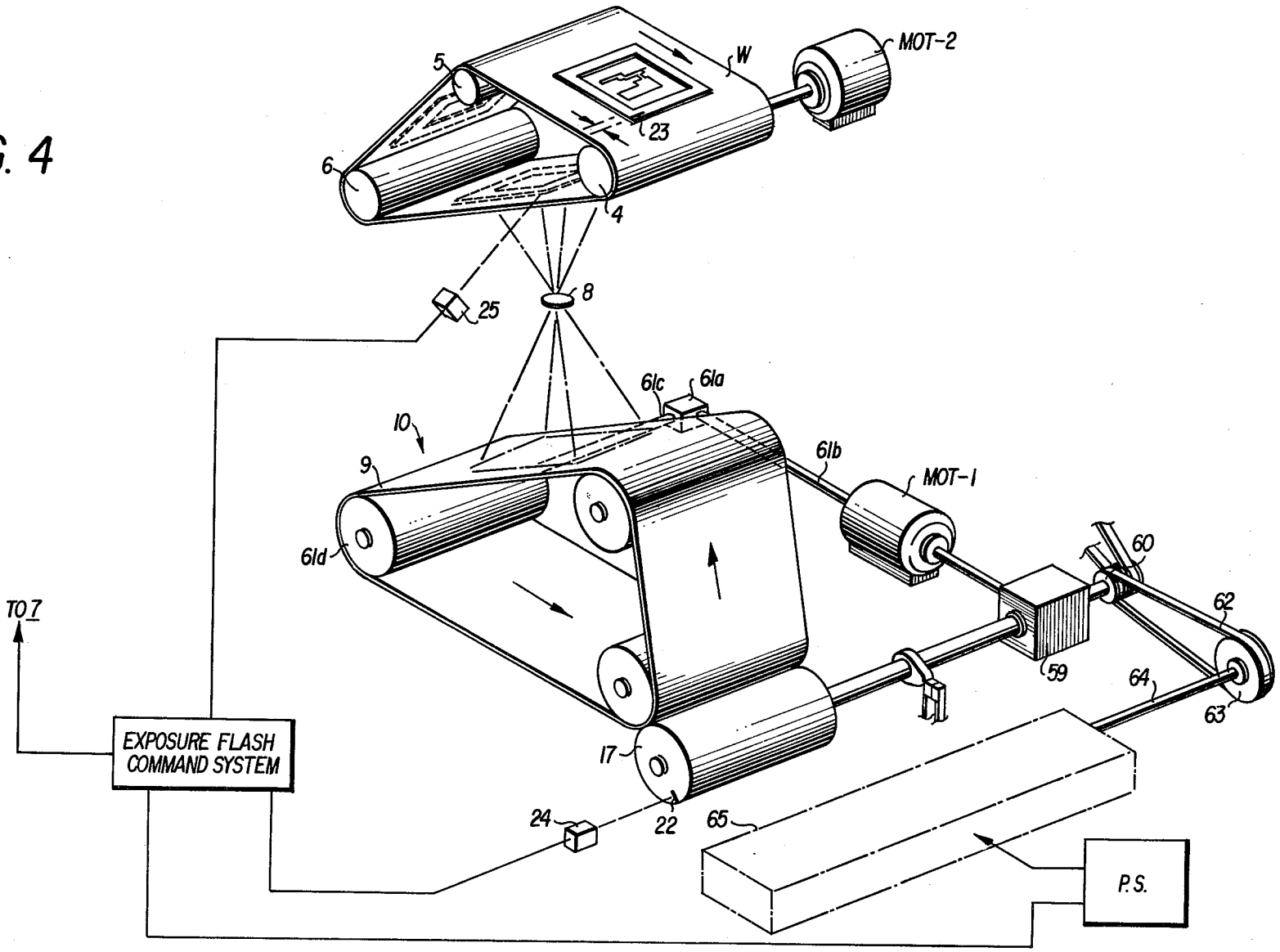
FIG. 4 is a schematic partially isometric view of a programming mechanism for controlling the machine of FIG. 1.

To determine the correct timing of the flash, a timing mark 22 is placed on bias transfer roll 17 and a timing mark 23 is placed on the border of master $D_1$, as shown in FIG. 4. Timing mark 22 is sensed by a sensor 24 and timing mark 23 is sensed by a sensor 25 as shown in FIG. 4.

The present invention is based on the following formula:

Flash time $\nabla$ from $0 = c - (BTR - 0/2)$ where $C =$ a constant, $BTR =$ the start time on sensing the timing mark 22 on the bias transfer roll, and $0 =$ the time of sensing timing mark 23 on master $D_1$ after sensing the timing mark 22. The constant C is a factor which takes into account the distance *d* on a master (see FIG. 4) between the timing mark 23 on the border of the master and the approximate position of the flash in order to render the above number always positive. The factor 2 is required because the areal image and the portion of belt 9 on which the latent image should be placed are moving towards each other at equal velocities. The areal image and this portion of the belt 9 could be made to move towards each other at any selected velocity, but then the denominator 2 would be changed in the equation.

FIG. 2A illustrates the positional relationship of master $D_1$ at the time the timing mark 22 is sensed, as well as the relative positions of the areal image and the correct placement of the image on belt 9. Four clock units after sensing the timing mark 22, the master $D_1$ has moved to a position where its timing mark 23 is sensed. If $C = 4$ units, then from the above-formula the flash time $\nabla = 4 - 4/2 = 2$; i.e., lamp assembly 7 should flash 2 time units after timing mark 23 is sensed.

FIG. 2B shows a situation where master $D_2$ is 2 time units late compared to master $D_1$ at the instant timing mark 22 is sensed. Therefore, 6 time units will have passed from the moment timing mark 22 is sensed to the time mark 23 is sensed. Accordingly, the flash time $\nabla = 4 - 6/2 = 1$; i.e. lamp assembly 7 should flash 1 time unit after sensing mark 23.

FIG. 2C shows the relationship where master $D_3$ is 2 time units ahead compared to master $D_1$ at the time mark 22 is sensed. Therefore, only 2 time units will have elapsed from the instant timing mark 22 is sensed to the moment timing mark 23 is sensed. Accordingly, the flash time $\nabla = 4 - 2/2 = 3$; i.e., lamp assembly 7 should flash 3 time units after sensing mark 23.

Figure 3:
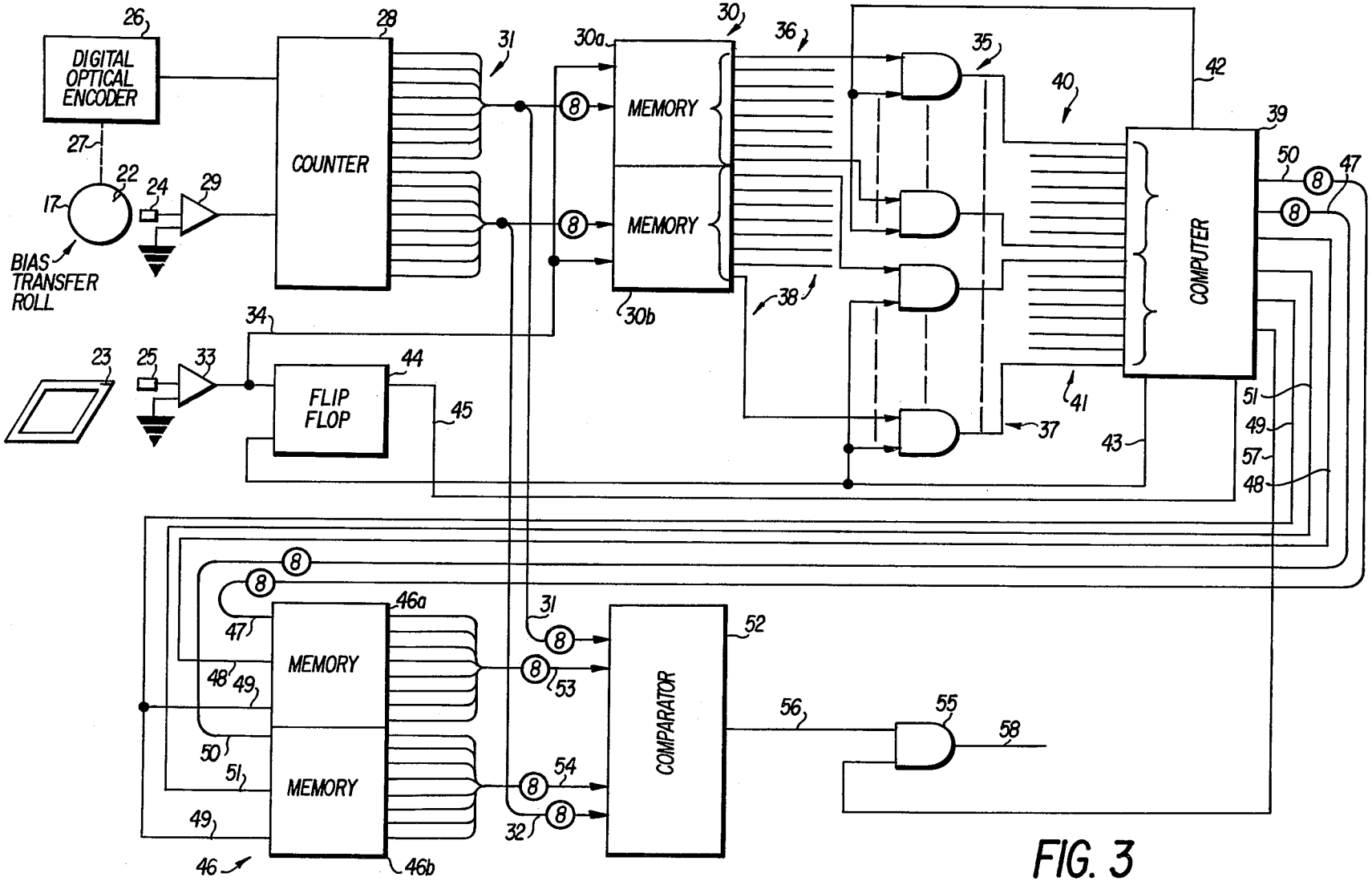
FIG. 3 is a schematic diagram of the exposure flash command system controlling the timing of flash exposure.

FIG. 3 illustrates schematically the circuit structure or exposure flash command system for determining the timing of lamp assembly 7. A digital optical encoder 26, known in the art, is connected to the rotating shaft 27 of bias transfer roll 17. Encoder 26, for example, may generate 1 pulse per 0.0001 inch of shaft rotation. A 16 bit binary counter 28 receives and counts the clock pulses from encoder 26, and is reset with a signal from amplifier 29 whose one input is connected to sensor 24, the other input of amplifier 29 being grounded.

A 16 bit memory 30 comprising two 8 bit memories 30*a* and 30*b* is connected to the output of counter 28 via lines 31, 32. Memory 30*a* stores the 8 least significant bits (lsb) from line 31 and memory 30*b* stores the 8 most significant bits (msb) from line 32. Memory 30 is enabled to transfer and store the data in counter 28 by an output signal from an amplifier 33 having one input connected to sensor 25 and the other input grounded. The output signal of amplifier 33 is fed over line 34 to memories 30*a* and 30*b*.

A bank of 8 AND gates 35 each have one input connected to memory 30*a* for receiving the 8 lsb's over lines 36. Another bank of AND gates 37 each have one input connected to memory 30*b* for receiving the 8 msb's over lines 38. A computer 39, which calculates the timing of flash exposure of the lamp assembly 7 from the above-mentioned equation, receives the data in memories 30*a*, 30*b* over the AND gate output lines 40, 41 by providing, sequentially, enabling signals over lines 42, 43 to the other inputs of AND gates 35 and 37, respectively.

A flip-flop 44 has its set input connected to the output of amplifier 33 over line 34 and its reset input connected to line 43 from computer 39. When flip-flop 44 is set, an output signal is fed over line 45 to activate computer 39 to generate the enabling signals over the lines 42, 43.

As indicated above, computer 39 calculates the timing of flash exposure from the data stored in memory 30. The calculated timing information, which is also in the form of binary data, is stored in memory 46 which comprises memory 46*a* and 46*b* for storing, respectively, 8 lsb's and 8 msb's. These 16 bits represent the time at which flash exposure should occur.

Memory 46*a* receives the 8 lsb's from computer 39 over 8 data lines 47 and this data is fed into the memory via an enabling signal from the computer over line 48. The lsb's are clocked into memory 46*a* with a clock signal over line 49 which is provided by computer 39.

Memory 46*b* receives the 8 msb's from computer 39 over 8 data lines 50 and this data is fed into the memory via an enabling signal from the computer over line 51. The msb's are clocked into memory 46*b* with the clock signal over line 49 provided by computer 39.

A 16 bit comparator 52 receives the 16 bit output from counter 28 over data lines 31, 32 and the 16 bit output from memory 46 over data lines 53, 54. Comparator 52 compares the data from counter 28 and memory 46 and, when the data is identical, provides a flash command output signal as one input to AND gate 55 over line 56. AND gate 55 is enabled via a flash enable signal generated by computer 39 and fed as the other input to AND gate 55 over line 57. The gated signal from AND gate 55 is fed over line 58 to trigger lamp assembly 7.

The operation of the circuitry of FIG. 3 is as follows. With the xerographic machine turned on to make a color copy, bias transfer roll 17 will rotate on rotating shaft 27. For each 0.0001" of rotation of transfer roll 17, digital shaft encoder 26 generates a pulse which is counted by counter 28. As transfer roll 17 rotates, timing mark 22 will be sensed by sensor 24 and amplifier 29 will thereby reset counter 28 to commence counting the pulses from encoder 26 starting from 0.

Then, as, for example, master $D_1$ moves into exposure station A, sensor 25 detects the timing mark 23. Amplifier 33 then generates the enabling signal to transfer the binary count of counter 28 at that instant into memory 30, with the 8 lsb's being stored in memory 30*a* and 8 msb's being stored in memory 30*b*. The count stored in memory 30 corresponds to the term BTR to 0 in the above given equation. Thus, at this time there is sufficient information for computer 39 to calculate the timing of flash exposure.

At the same time the data is read into memory 30, flip-flop 44 is set to activate computer 39. As a result, AND gates 35, 37 are enabled, respectively, to transfer the data stored in memories 30*a* and 30*b* into computer 39. Computer 39 then computes the timing ∇ of flash exposure on the basis of the above mentioned equation and generates a 16 bit word representing the timing ∇. This 16 bit word is first clocked into memory 46, with the 8 lsb's being stored in memory 46*a* and the 8 msb's being stored in memory 46, and then fed into comparator 52.

As bias transfer roll 17 keeps rotating, the count in counter 28 increases and is also fed to comparator 52. When the count in counter 28 is identical to the 16 bit word in memory 46, it is an indication that master $D_1$ has moved to the correct position for flash exposure. Consequently, comparator 52 makes the comparison and generates a command signal which is gated through gate 55 by the enabling signal from computer 39 to trigger lamp assembly 7. The enabling signal over line 57 is used to prevent noise in the system from enabling gate 55, thereby resulting in an undesireable flash.

When computer 39 enables AND gates 37 to transfer the 8 msb's from memory 30*b* after transfer of the 8 lsb's from memory 30*a*, the flip-flop 44 is also reset. The circuit is now ready to calculate the timing of flash exposure for the next master $D_2$ when the timing mark 22 on bias transfer roll 17 is again sensed.

It will be appreciated that the separations of the masters $D_1$, $D_2$ and $D_3$ on web W should nominally be equal to, and not smaller than, the diameter of the bias transfer roll 17. Otherwise, for example, the timing mark on master $D_2$ might be sensed before the timing mark on transfer roll 17 is again sensed. For this reason, also, the speed of web W and transfer roll 17 should be nominally equal.

FIG. 3 shows the data being transferred from memory 30 into computer 39 in two groups of 8 bits (the lsb's and msb's), and being transferred out of computer 39 into memory 46 also in two groups of 8 bits. This is because computer 39 comprises memories of only 8 bit storage capacity. It will be appreciated by those skilled in the art that if computer 39 uses 16 bit memories, then the data into and out of the computer may be processed in single groups of 16 bits.

The programming system for the machine illustrated in FIG. 1 is shown schematically in FIG. 4. In order to commence operation of the machine, it will be assumed that the machine shown in FIG. 1 has been turned on and that all warm-up periods have terminated and the machine is in condition to reproduce copies from the masters. It is also assumed that power supplies for all the elctrical components such as the charge corotron 11, the heater elements for the fuser 20 and the power supply for the programming system have been energized.

To start color production a drive motor MOT-1 for belt assembly 10 and transfer roll 17, and a drive motor MOT-2 for web W may be simultaneously energized by a single push button (not shown). As shown in FIG. 4, this motor MOT-1 is connected to a gear box 59 which in turn is connected to the drive shaft 27 for the transfer roller 17 and to a pulley 60. The motor MOT-1 is also connected through a gear box 61*a* and shafts 61*b*, 61*c* to a drive roller 61*d* for the belt assembly 10 for driving the belt 9 in its closed path of movement during a production run.

The pulley 60 is connected by a belt 62 to a larger pulley 63 mounted on a program shaft 64 upon which are mounted for rotation therewith a plurality of camming devices 65 for operating associated switches in the programming system PS. The programming system PS includes logic for the machine, its power supplies, timers, controls, selection devices for multiple copying, and other components for the programming function, the effect of which will not be described. The relative size differential between pulley 60 and pulley 63 is 3:1, for a three color reproducing operation such that the shaft 27 for the transfer roll 17 will make three revolutions for every revolution of the programming shaft 64.

Upon energization of the motor MOT-1 the belt 9, the roller 17 and the programming shaft 64 will be continuously rotated in time related sequence in order to effect the automatic forming of a plurality of electrostatic latent images, development of the images in proper sequence, and transfer of each of the images in superimposed relationship on sheet S.

U.S. Pat. No. 3,724,943 previously mentioned throughout this disclosure describes in detail the specific programming structure for performing operations at the charging, development and transfer stations. This programming structure may be used in the present invention for such operations and, consequently, the entire U.S. Pat. No. 3,724,943 is incorporated by reference herein. It will, of course, be appreciated that though this patent also discloses structure for imaging at the exposure station, it is the structure of the present invention shown in FIGS. 3 and 4 which is to be used for the exposure operation to assure superposition of images at the transfer station in a system having moving documents to be copied such as masters $D_1$, $D_2$, $D_3$.

There are a number of advantages to the technique of the present invention for proper imaging at an exposure station to obtain accurate superposition of images at the transfer station. The apparatus, being primarily electronic, requires few mechanical moving parts and eases much of the mechanical tolerancing. The speed or response of the invention is limited only to sensor and electronic responses, and high accuracy can be obtained. Also, a tie is maintained between the bias transfer roll and the documents to be copied. Furthermore, the invention can be applied to any flash system device, either for the superposition of images or for locating one image with respect to paper such as sheet S.

The present invention is also applicable to a system in which the masters $D_1$, $D_2$, $D_3$ move in the opposite direction to the photoconductor belt 9 so that the areal image will move in the same direction as the belt 9. The key is to establish a relative velocity difference between the areal image and the area on the belt 9 upon which the latent image is to be located. In this case the such areal image and area will cross and similar computations as described above can be used to determine the timing of the flash.

Furthermore, it will be appreciated that the present invention will perform equally well with color separation masters which are not transparent. In this case, lamp assembly 7 would be located to provide light that will reflect off the masters and into lens 11.

While the invention has been described with reference to the structure disclosed herein, it is not confined to the details set forth, but is intended to cover such modifications or changes as may come within the scope of the following claims.

What is claimed is:

1. A reproduction machine for processing color separation masters comprising an exposure station including a flash lamp, an imaging surface movable past said station, means for moving a plurality of said color separation masters past said exposure station successively, means for energizing said lamp to create a plurality of spaced apart electrostatic latent images on said imaging surface, means for developing said successive images with different color developer, rotatable means for successively bringing a support surface into contact with said developed images, and means for controlling the energization of said lamp in dependence on the position of said master to be exposed relative to the moving support surface.

2. A multicolor electrostatic printing apparatus for reproducing a color original represented by a plurality of separation masters each containing information as to the color content of the original, comprising:

(a) a movable photoconductor member;
(b) means for moving the separation masters;
(c) means for generating light rays of each of the separation masters and to form a series of spaced apart electrostatic latent images on said member as the separation masters move;
(d) developer means, having a plurality of development units, for developing the latent images, each development unit including means for applying developing material having a different color for each of the latent images;
(e) transfer means for transferring the developed images onto a support material, said transfer means including a rotatable transfer roll; and
(f) means for enabling the developed images to be transferred in superimposed relationship onto the support material, said means for enabling including means for producing electrostatic latent images which are equally spaced apart from one another a predetermined distance on said photoconductor member, said means for producing including means for varying the time said generating means generates the light rays for each of said masters by comparing the position of said masters to the rotatable position of a predetermined part of said transfer roll.

3. A machine for processing a plurality of color separation masters, each master corresponding to the color content of a colored original to be reproduced, said masters having a first timing mark associated therewith comprising, an imaging surface, an exposure station, means for moving said imaging surface past said exposure station, said exposure station including a flash lamp to generate pulsed light images corresponding to said masters and means for projecting said images onto said surface to create a plurality of spaced apart latent electrostatic images on said surface, developer means for developing each successive image with different colored developer material, means for supporting a copy sheet for rotation into successive contact with each of said developed images, said means for supporting including a second timing mark, means for generating signals upon the detection of said first and second marks, and means for controlling the flash of said lamp for each of said masters based on the timed relationship between said signals, whereby each of said developed images corresponding to the color content of a colored original to be reproduced are superimposed in registration on each other and on said copy sheet.

4. A multicolor electrostatic printing apparatus for reproducing a color original represented by a plurality of separation masters each containing information as to the color content of the original and each having a first timing mark, comprising:

(a) a movable photoconductor belt;
(b) means for moving the separation masters;
(c) means for electrostatically charging said belt;
(d) flash exposure means for generating light rays of each of the separation masters and to form a series of spaced apart electrostatic latent images on said belt as the separation masters move;
(e) developer means, having a plurality of development units, for developing the latent images, each development unit including means for applying developing material having a different color for each of the latent images;
(f) rotatable transfer means for transferring the developed images onto a support material; and
(g) means for superimposing the developed images onto the support material, including a second timing mark on said rotatable transfer means, first means for sensing said first timing mark, second means for sensing said second timing mark, and means, coupled to said first and second sensing means, for activating said flash exposure means to generate the light rays at a determined time after said second timing mark is sensed, said activating means including means for determining the time said flash exposure means is activated in dependence on the time the first timing mark and said second timing mark are sensed.

5. A multicolor electrostatic printing apparatus in accordance with claim 4 wherein said means for determining includes means for determining the elapsed time between sensing said second timing mark and sensing the first timing mark, and means for calculating the timing of the flash exposure means based on this elapsed time.

6. A multicolor electrostatic printing apparatus in accordance with claim 4 wherein said means for determining includes means for producing clock pulses as said transfer means rotates, means for counting the clock pulses, means, connected to said counting means, for storing a signal corresponding to the time difference between the time said second timing mark is sensed and the time the first timing mark is sensed, means for receiving the stored signal and, based on the information provided by the received signal, generating a signal corresponding to the time when said flash exposure means should be activated, and means for comparing the count of said counting means and the signal generated by said generating means, said comparing means producing an output signal for activating said flash exposure means when the count of said counting means and the generated signal compare.

* * * * *